US007997932B2

(12) United States Patent
Xu

(10) Patent No.: US 7,997,932 B2
(45) Date of Patent: Aug. 16, 2011

(54) SHIELED CONNECTOR HAVING LEVELING ARRANGEMENT ENSURING RELIABLE INTERCONNECTION

(75) Inventor: Feng Xu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/807,566

(22) Filed: Sep. 7, 2010

(65) Prior Publication Data

US 2011/0059626 A1 Mar. 10, 2011

(30) Foreign Application Priority Data

Sep. 7, 2009 (CN) ..... 2009 0 309723

(51) Int. Cl.
*H01R 13/648* (2006.01)

(52) U.S. Cl. ..... 439/607.04

(58) Field of Classification Search ..... 439/660, 439/83, 670, 79, 80, 377, 567, 589, 571, 439/607.04, 607.37
See application file for complete search history.

(56) References Cited

U.S. PATENT DOCUMENTS

| | | | | |
|---|---|---|---|---|
| 6,767,251 | B2 * | 7/2004 | Yu et al. | 439/79 |
| 6,793,531 | B1 * | 9/2004 | Zhang | 439/607.04 |
| 7,473,143 | B2 * | 1/2009 | Chen | 439/670 |
| 2008/0057795 | A1 * | 3/2008 | Chen | 439/723 |
| 2009/0130870 | A1 | 5/2009 | Wu et al. | |
| 2010/0322566 | A1 * | 12/2010 | Zheng et al. | 385/74 |

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

A shield connector (100) includes a metallic shell (3) with a mating port (331) in communication with a mating receptacle with a tongue having a plurality of contact terminals (2) thereon. The contact terminals (2) include a plurality of solder tails (213, 223) extending out of the metallic shell (3). The metallic shell (3) defines a level arrangement (35) adjacent to the mating port (331) and defining a supporting plane coplanar to a mounting interface (5) of the shield connector (100).

20 Claims, 6 Drawing Sheets

SHIELED CONNECTOR HAVING LEVELING ARRANGEMENT ENSURING RELIABLE INTERCONNECTION

BACKGROUND OF THE INVENTION

1. Field of the Invention

The present invention relates to a shield connector, and more particularly to a shield connector having leveling arrangement ensuring reliable interconnection as well as mating capability.

2. Description of the Related Art

Nowadays, more and more electrical connectors has been designed so as to partially sunk into an opening of a printed circuit board (PCB) so as to meet the miniature trend. US Pat. Publication No. 2009/0130870 submitted by Wu et al. on Sep. 30, 2008, discloses a common sunk-typed connector mounted to a PCB for low profile. The connector includes an insulative housing, a plurality of contacts received in the housing and a metallic shell shielding insulative housing. The metallic shell is folded from a single sheet of metal so as to include a top wall, a bottom wall interconnected to the top wall by a pair of side walls. Each of the contacts includes a soldering tail extending outside of the insulative housing. The metallic shell defines a pair of soldering tails respectively extending from those two side walls and in parallel to the top wall or the bottom wall for soldering onto the PCB and helping the connector stood on the PCB. The connector is very much likely cantilevered from an edge of the PCB.

However, the soldering tails of the metallic shell is still arranged on the rear side of the electrical connector, i.e. most of the electrical connector is cantilevered from the PCB merely retained by solder joints of the soldering tails of the contacts soldered to the PCB. Once excessive mating force or inadvertently downward force is applied, those solder joints are under jeopardy and vulnerable to break apart. So the electrical connector will be turned over and unable to stand to the PCB steadily.

Therefore, an improved electrical connector is desired to overcome the disadvantages of the related arts.

SUMMARY OF THE INVENTION

An object of the present invention is to provide a low profile shield connector steadily mounted to and properly supported on a PCB so as to ensure reliable interconnection thereof.

In order to achieve the above-mentioned object, a shield connector in accordance with a preferred embodiment of the present invention includes a metallic shell with a mating port in communication with a mating receptacle with a tongue having a plurality of contact terminals thereon. The contact terminals include a plurality of solder tails extending out of the metallic shell. The metallic shell defines a level arrangement adjacent to the mating port and defining a supporting plane coplanar to a mounting interface of the shield connector.

Other objects, advantages and novel features of the invention will become more apparent from the following detailed description of the present embodiment when taken in conjunction with the accompanying drawings.

DETAILED DESCRIPTION OF THE INVENTION

Figure 1:
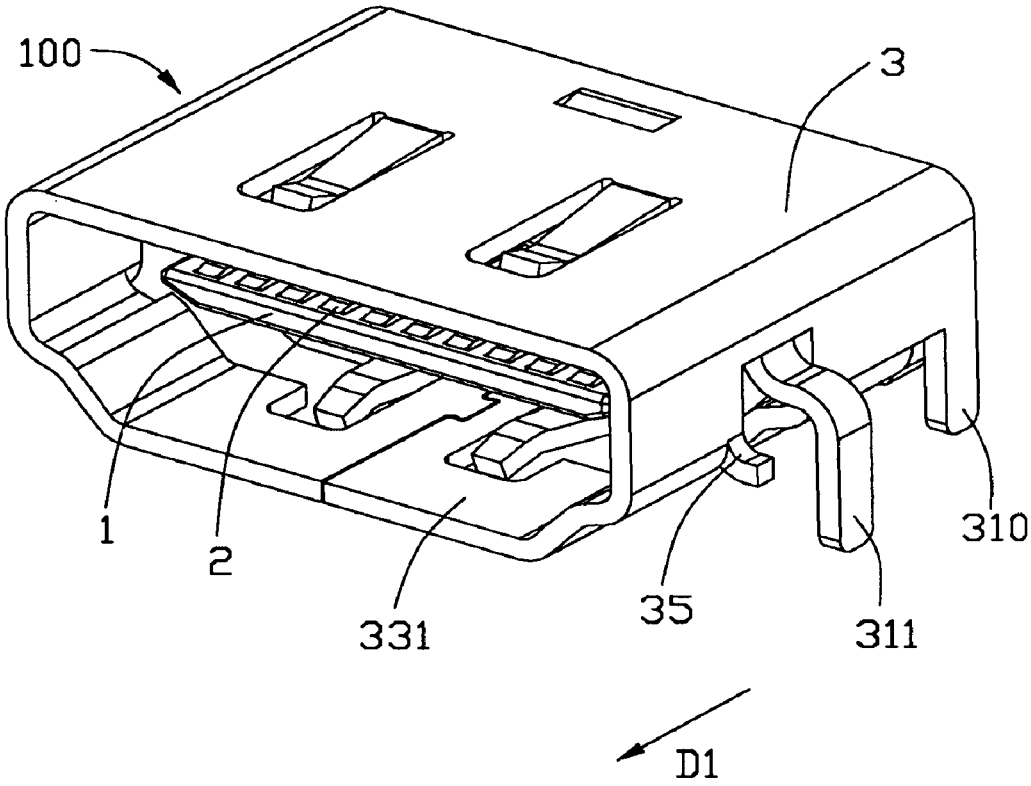
FIG. 1 is a perspective view of a shield connector in accordance with the preferred embodiment of the present invention.

Reference will now be made to the drawing figures to describe the preferred embodiment of the present invention in detail.

Figure 2:
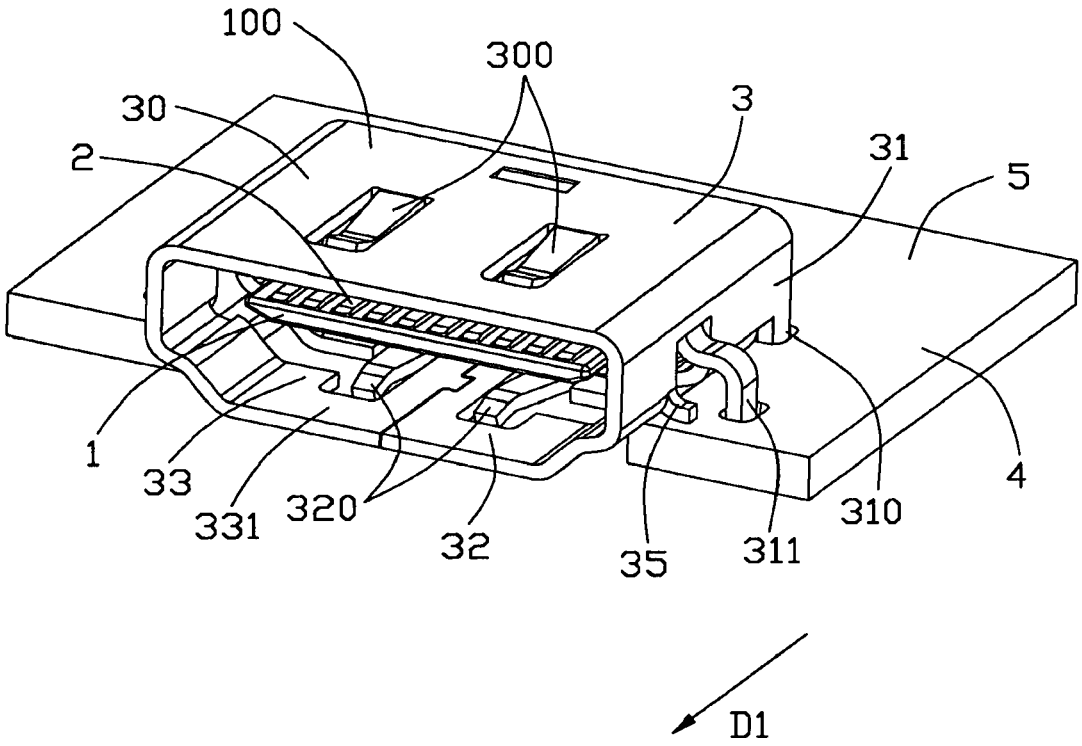
FIG. 2 is a perspective view of the shield connector of FIG. 1 assembled with a PCB.

Referring to FIGS. 1 and 2, a shield connector 100 in accordance with the present invention is a low profile connector in which the connector is spanned over an opening of a printed circuit board (PCB) 4 such that the lower portion of the connector is coplanar to a low surface of the PCB 4 so as to reduce the overall height above the PCB 4. The shield connector includes an insulative housing 1 with a plurality of contact terminals 2 assembled therein and a metallic shell 3 surrounding the insulative housing 1.

Figure 3:
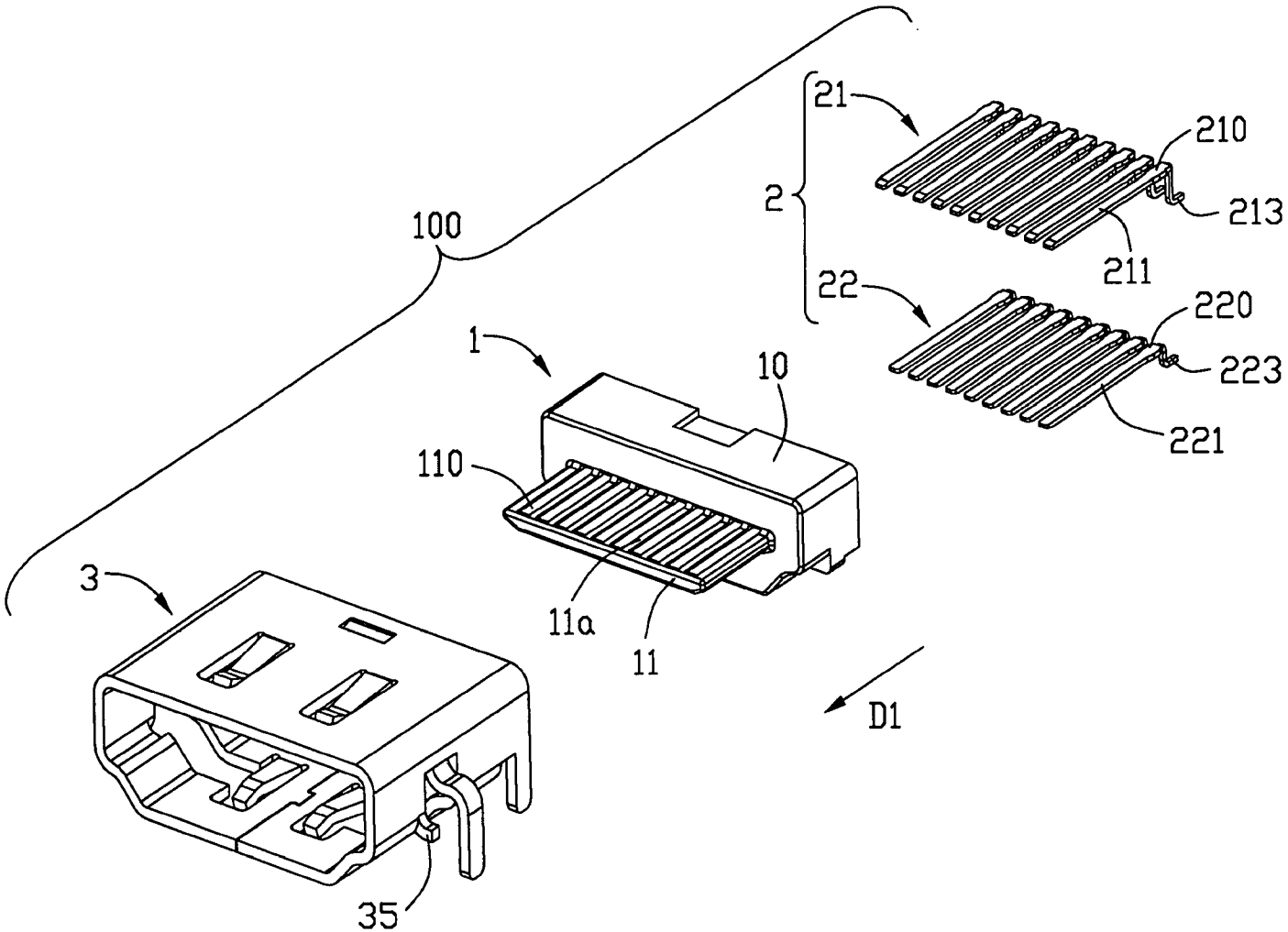
FIG. 3 is an exploded perspective view of FIG. 1.
Figure 4:
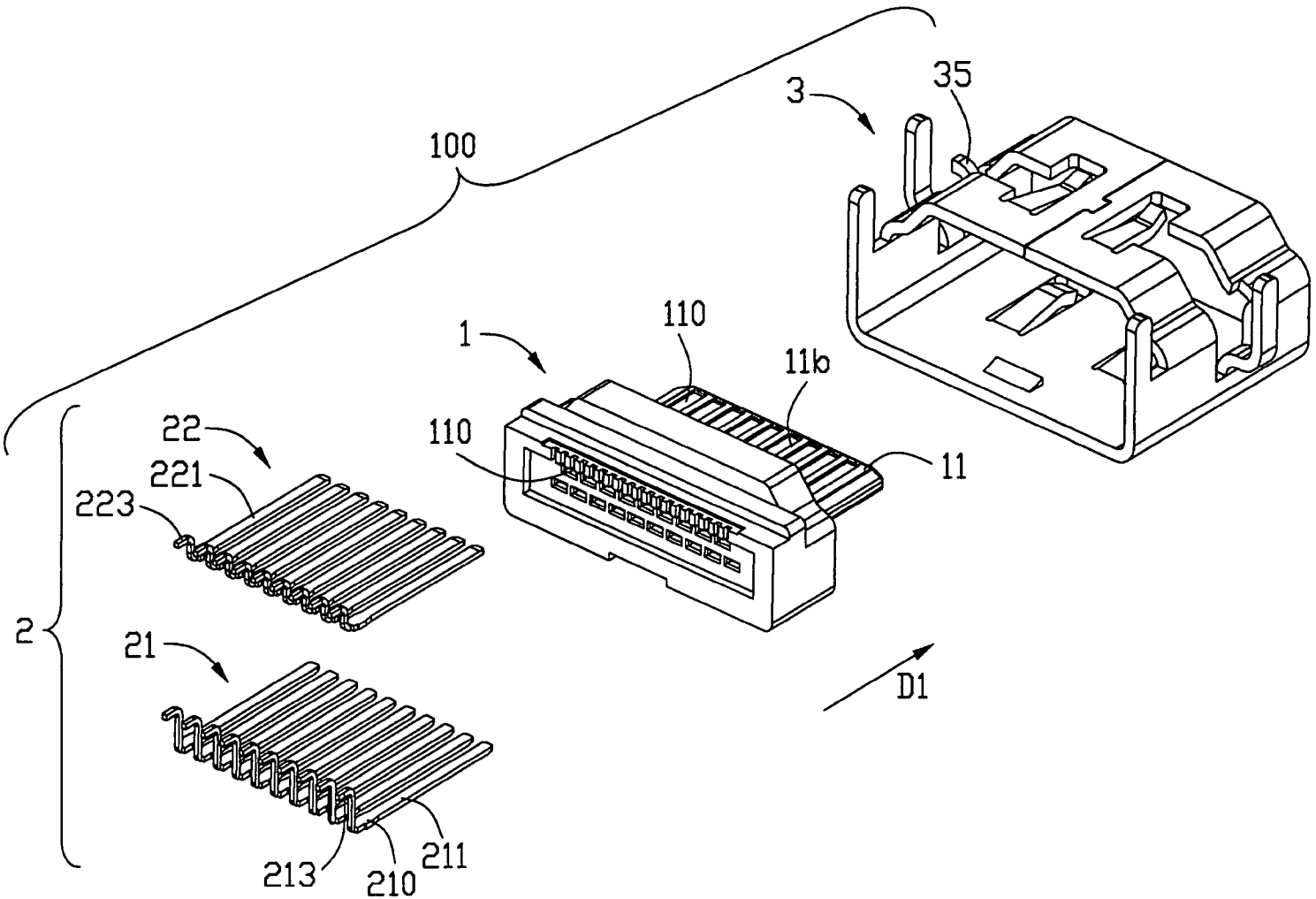
FIG. 4 is another exploded perspective view of FIG. 1 from a rear side view.
Figure 5:
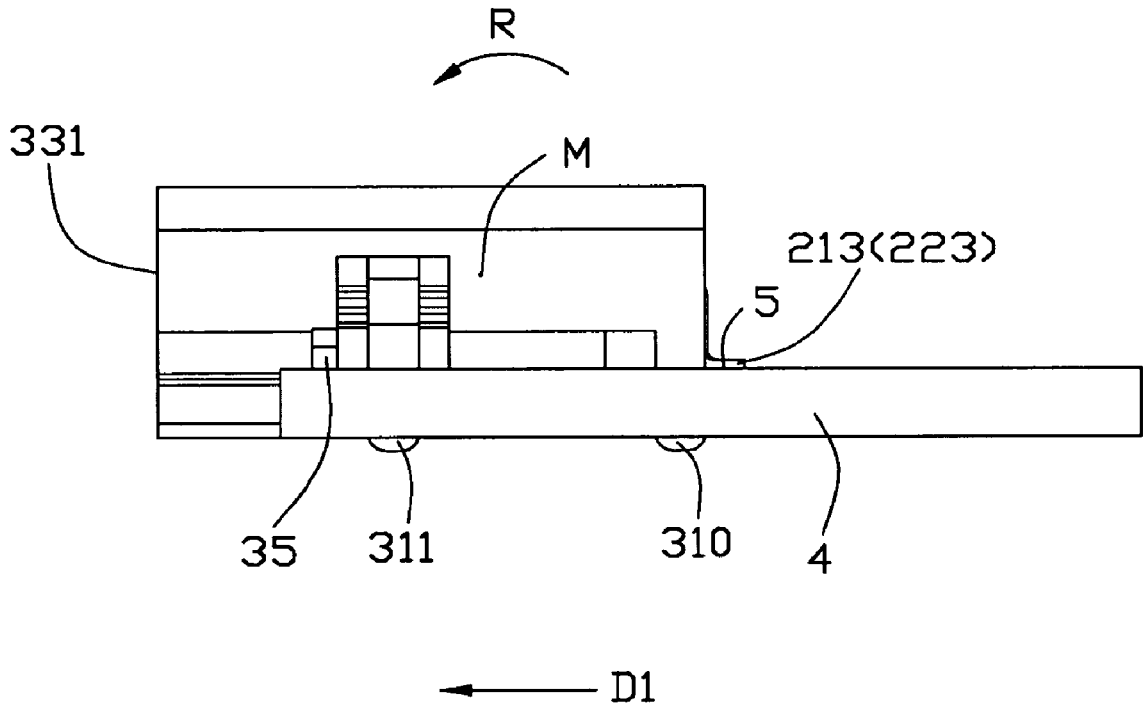
FIG. 5 is a side elevational view of FIG. 2.

Referring to FIGS. 3 to 5, the insulative housing defines a body portion 10, an engaging portion 11 extending from the body portion 10 and a plurality of receiving grooves 110 extending through the body portion 10 and the engaging portion 11 along a rear-to-front direction (i.e. mating direction) as marked by arrow D1. The contact terminals 2 are inserted into the insulative housing along the D1 direction. The contact terminals 2 are grouped into a first set 21 and a second set 22 respectively settled down on an upper side 11*a* and a lower side 11*b* of the engaging portion 11, thereby forming a tongue-shaped configuration. Each of the first set contact terminals 21 includes a retaining portion 210 retained in the insulative housing 1, a contacting portion 211 extending from one end of the retaining portion 210 and a solder tail 213 extending outwards from another end of the retaining portion 210 for soldering onto the PCB 4. The second set contact terminals 22 have a configuration similar to the first set contact terminals 21, each of which includes a retaining portion 220, a contacting portion 221 and a solder tail 223. Additionally, the solder tails 213, 223 of the contact terminals 2 are coplanar to each other, thereby forming a plat interface which overlaps a mounting interface 5 of the shield connector 100 on the PCB 4.

Referring to FIGS. 2 and 3, the metallic shell 3 is assembled on the insulative housing 1 finally. The metallic shell 3 includes a top wall 30, a pair of side walls 31 interconnected with and perpendicular to the top wall 30 and a bottom wall 32 unitarily connecting with the side walls and opposite to the top wall 30, thereby forming a mating room 33 surrounding the engaging portion 11 with a mating port 331. The contacting portions 211, 221 are exposed to the mating room 33 for electrically connecting with a mating receptacle (not shown) inserted into the mating room 33. The top wall 30 has a pair of spring arms 300 opposite to a pair of spring arms 320 defined by the bottom wall 32 for clipping with said mating receptacle.

Figure 6:
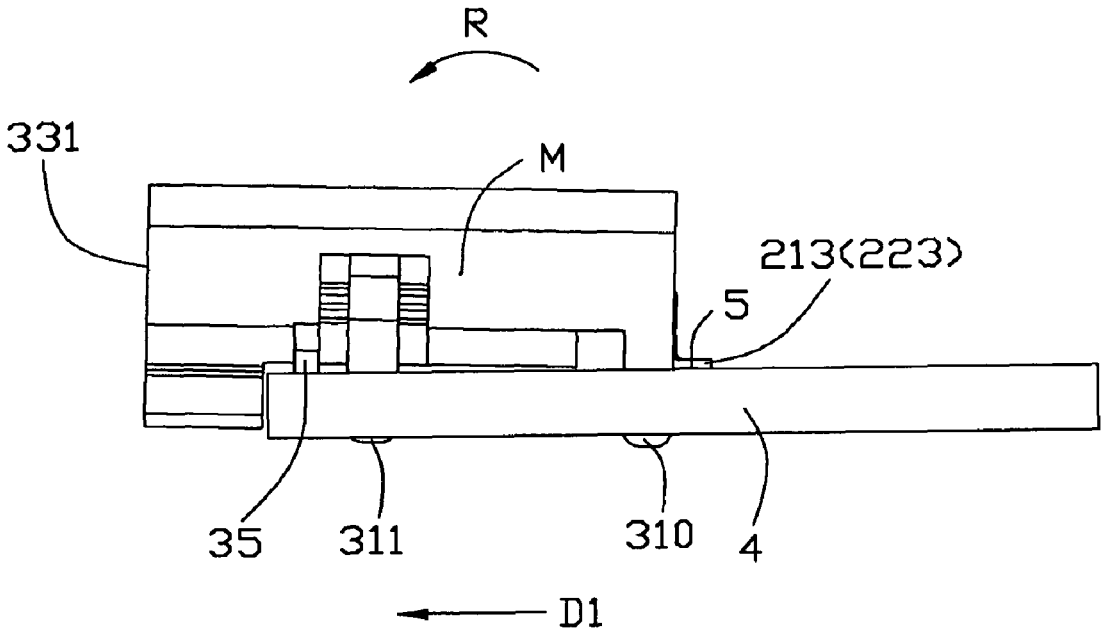
FIG. 6 is a side elevational view of the shield connector obliquely mounted onto the PCB in which a mating port thereof is lifted upward slightly.

Referring to FIGS. 1, 2 and 5, each of the side walls 31 is provided with a first leg 310, (i.e. a rear mounting leg 310), a second leg 311 (i.e. a front mounting leg 311) closer to the mating port 331 than the first leg 310 which are both connected with the PCB 4 (for example soldering or blocking with the PCB 4). The first and second legs 310, 311 are both perpendicular to the mounting interface 5 for extending through the PCB 4. A level arrangement 35 (or a standoff 35) is integrally arranged at each corner of the side wall 31 and the bottom wall 32 and defines a supporting plane which is coplanar to the mounting interface 5 for standing on the PCB 4. The level arrangements 35 are adjacent to the mating port 331. Furthermore, the level arrangements 35 are either soldered onto the PCB 4 or freely stand on the PCB for adjusting the position thereof conveniently. The overall height of the level arrangement 35 can be selectively designed to ensure the mounting interface 5 is coplanar to the PCB 4. For example, if the mating port 331 is to be lifted upward slightly or to any angle for intended purpose, then the level arrangement 35 can be lengthened or change its position to meet the requirement to properly support the mating port 331 above the printed circuit board 4 (as best shown in FIG. 6). The level arrangements 35 are closer to the mating port 331 than the first leg 310 and second leg 311 of the metallic shell 3 along the D1 direction, i.e. they are disposed at a front side of the center of gravity M of the shield connector 100. Furthermore, the solder tails 210 are located at a rear side of the center of gravity M. So the level arrangements 35 can prevent the connector 100 from turning over along a counterclockwise direction as marked by arrow R, viewed from right side of the connector 100. The shield connector will be steadily mounted to and properly supported on a PCB so as to ensure reliable interconnection thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A shield connector, comprising:

a metallic shell with a mating port in communication with a mating receptacle with a tongue having a plurality of contact terminals thereon, each contact terminal including a solder tail extending out of the metallic shell; and wherein the metallic shell comprises a front mounting leg closer to the mating port and an individual level arrangement located next to the mating port and defining a supporting plane for capable of standing upon a printed circuit.

2. The shield connector as described in claim 1, wherein the level arrangement of the metallic shell comprises a horizontal end portion coplanar to a mounting interface formed by the solder tails of the contacts for being assembled upon a PCB.

3. The shield connector as described in claim 2, wherein the metallic shell comprises an individual rear mounting leg arranged at rear of the shell, the front mounting leg and the rear mounting leg are perpendicular to the mounting interface and offset from the level arrangement in a front-to-back direction for extending through corresponding through holes in said PCB.

4. The shield connector as described in claim 3, wherein the front mounting leg comprises a horizontal connecting portion disposed over and not engagement with the mounting interface, and a vertical leg portion extending from the horizontal connecting portion for extending through a PCB.

5. The shield connector as described in claim 4, wherein the front mounting leg is closer to the mating port than the rear mounting leg.

6. The shield connector as described in claim 2, wherein the metallic shell comprises a bottom wall is lower than the mounting interface, a top wall opposite to the bottom wall which is higher than the mounting interface.

7. The shield connector as described in claim 6, wherein the top wall and the bottom wall are interconnected to the top wall by a pair of side walls, in which the level arrangement is integrally arranged at each corner of the side wall and the bottom wall.

8. An interconnecting system, comprising:

a printed circuit board (PCB) with a mounting area and a shield connector connecting with the PCB, thereby forming a mounting interface coplanar to an upper side of the PCB;

the shield connector comprising an insulative housing with a plurality of contact terminals assembled therein and a metallic shell surrounding the insulative housing;

the contact terminals comprising a plurality of solder tails; and wherein the metallic shell comprises a pair of level arrangements which are disposed on a front side of the center of gravity of the shield connector and defines a horizontal end portion extending along a horizontal direction for engaging with the PCB, the solder tails are located on a rear side of the center of gravity.

9. The interconnecting system as described in claim 8, wherein the level arrangements are either soldered onto the PCB or freely stand on the PCB for adjusting the position thereof conveniently.

10. The interconnecting system as described in claim 8, wherein the shell comprises an individual pair of mounting legs which defines a horizontal connecting portion disposed over and not engagement with the PCB, and a vertical leg portion extending through the PCB from the horizontal connecting portion.

11. The interconnecting system as described in claim 9, wherein the shell surrounds the insulative housing, thereby forming a mating port, the level arrangement are disposed next to the mating port.

12. The interconnecting system as described in claim 10, wherein the level arrangement and the solder tail are partitioned by the mounting leg viewed from same side of the shield connector.

13. An electrical connector assembly comprising:

an insulative housing;

a metallic shell essentially enclosing the housing with opposite top and bottom walls and opposite two side walls, and cooperating with the housing to define a front mating port and a rear mounting port thereof in a front-to-back direction; and a plurality of contacts disposed in the housing, each of said contacts defining a front mating section exposed into the front mating port and a rear mounting section horizontally extending around the rear mounting port and located at a middle level of said shell; wherein the metallic shell defines a pair of front mounting legs closer to the front mating port than to the rear mounting port in the front-to-back direction, and at least a pair of standoffs extending outwardly on said two side walls around said middle level in a vertical direction perpendicular to said front-to-back direction, and located in front of said pair of front mounting legs and essentially being coplanar with the rear mounting sections for commonly mounting upon an upper surface of a printed circuit board.

14. The electrical connector assembly as described in claim 13, wherein the standoff of the metallic shell comprises a horizontal end portion coplanar to rear mounting sections of the contacts for being assembled upon a PCB.

15. The electrical connector assembly as described in claim 14, wherein the metallic shell comprises an individual rear mounting leg arranged at rear of the shell, the front mounting leg and the rear mounting leg are perpendicular to the mounting interface and offset from the level arrangement in a front-to-back direction for extending through corresponding through holes in said PCB.

16. The electrical connector assembly as described in claim 15, wherein the front mounting leg defines a horizontal connecting portion disposed upper than the horizontal end portion of the standoff and a vertical leg portion extending through the PCB from the horizontal connecting portion.

17. The electrical connector assembly as claimed in claim 13, wherein the front mounting leg defines an L-shaped configuration with a horizontal connecting portion for distantly located above the PCB and a vertical leg for extending downwardly from a free end of the horizontal connecting portion for further through a corresponding hole in the PCB, while the standoff essentially defines only a horizontal end portion without any vertical leg extending from a free end of the horizontal end portion.

18. The electrical connector assembly as claimed in claim 15, wherein said front mounting leg on each of said side walls is essentially located outside of the corresponding standoff in a lateral direction perpendicular to both said front-to-back direction and said vertical direction so as to assure the corresponding though hole in the printed circuit board is not close to the notch of the printed circuit board.

19. The electrical connector assembly as claimed in claim 18, wherein a bottom half portion of the shell with the enclosed housing is configured to be adapted to be snugly received in a notch of said printed circuit board.

20. The electrical connector assembly as claimed in claim 15, wherein the front mounting leg extends from a position of the corresponding side wall is higher than another position thereof where the corresponding standoff extends.

* * * * *